US009777749B2

(12) United States Patent
Franzoni et al.

(10) Patent No.: US 9,777,749 B2
(45) Date of Patent: Oct. 3, 2017

(54) ELECTRO-HYDRAULIC SYSTEM WITH FLOAT FUNCTION

(71) Applicant: Parker-Hannifin Corporation, Cleveland, OH (US)

(72) Inventors: Germano Franzoni, Prarie View, IL (US); Jarmo Harsia, Chicago, IL (US); Roger Lowman, Simpsonville, SC (US)

(73) Assignee: Parker-Hannifin Corporation, Cleveland, OH (US)

( * ) Notice: Subject to any disclaimer, the term of this patent is extended or adjusted under 35 U.S.C. 154(b) by 510 days.

(21) Appl. No.: 14/370,685

(22) PCT Filed: Jan. 7, 2013

(86) PCT No.: PCT/US2013/020513
§ 371 (c)(1),
(2) Date: Jul. 3, 2014

(87) PCT Pub. No.: WO2013/103954
PCT Pub. Date: Jul. 11, 2013

(65) Prior Publication Data

US 2014/0373519 A1 Dec. 25, 2014

Related U.S. Application Data

(60) Provisional application No. 61/583,356, filed on Jan. 5, 2012.

(51) Int. Cl.
*F15B 11/08* (2006.01)
*F15B 11/024* (2006.01)
*F15B 13/044* (2006.01)

(52) U.S. Cl.
CPC ..... *F15B 11/08* (2013.01); *F15B 11/024* (2013.01); *F15B 13/044* (2013.01); (Continued)

(58) Field of Classification Search
CPC ..... F15B 2211/3058; F15B 13/021; F15B 13/024; F15B 11/08; F15B 13/044; (Continued)

(56) References Cited

U.S. PATENT DOCUMENTS 3,590,867 A 7/1971 Tam et al.
4,218,837 A 8/1980 Peterman
(Continued)

FOREIGN PATENT DOCUMENTS

CN 1969129 A 5/2007
CN 1993524 A 7/2007
(Continued)

OTHER PUBLICATIONS

International Search Report for corresponding patent application No. PCT/US2013/020513 dated Jul. 9, 2013.
(Continued)

*Primary Examiner* — F. Daniel Lopez
*Assistant Examiner* — Dustin T Nguyen
(74) *Attorney, Agent, or Firm* — Renner, Otto, Boisselle & Sklar, LLP

(57) ABSTRACT

A method of controlling a float function of a cylinder 25 having a first side and a second side includes connecting the second side of the cylinder to a reservoir 15; connecting the first side of the cylinder to an output of a pump 20 and to the reservoir; and supplying an amount of flow from a pump less than an amount supplied by the pump under loaded conditions. A three-position directional control valve 30 having a pump port, a reservoir port, a first cylinder port, and a second cylinder port may be provided to effectuate aspects of this method.

18 Claims, 4 Drawing Sheets

(52) U.S. Cl.
CPC ..... *F15B 2211/3058* (2013.01); *F15B 2211/30565* (2013.01); *F15B 2211/31558* (2013.01); *F15B 2211/625* (2013.01); *F15B 2211/7053* (2013.01)

(58) Field of Classification Search
CPC ..... F15B 11/024; F15B 2211/30565; F15B 2211/31558; F15B 2211/7053; F15B 2211/625; F15B 2211/88; E02F 9/2203; E02F 9/2207; E02F 3/436; E02F 3/437
USPC ..... 60/469, 445; 91/437, 436
See application file for complete search history.

(56) References Cited

U.S. PATENT DOCUMENTS

| | | | | |
|---|---|---|---|---|
| 4,359,931 | A | 11/1982 | Palmersheim et al. | |
| 5,251,705 | A * | 10/1993 | Waggoner | E02F 9/2203 172/812 |
| 5,651,390 | A * | 7/1997 | Ishihama | E02F 9/2225 137/596 |
| 5,809,862 | A * | 9/1998 | Dallman | F15B 11/028 91/26 |
| 5,907,991 | A * | 6/1999 | Ramamoorthy | E02F 9/2203 91/436 |
| 6,450,081 | B1 | 9/2002 | Sorbel | |
| 6,682,154 | B1 | 1/2004 | Haeussler et al. | |
| 7,124,576 | B2 | 10/2006 | Cherney et al. | |
| 7,337,610 | B2 * | 3/2008 | Bitter | E02F 9/2207 60/413 |
| 7,383,682 | B2 | 6/2008 | Kauss | |
| 8,047,121 | B2 * | 11/2011 | Yamamoto | E02F 3/844 91/436 |
| 2004/0088972 | A1 * | 5/2004 | Harnischfeger | E02F 9/2207 60/469 |
| 2005/0066655 | A1 | 3/2005 | Aarestad et al. | |
| 2007/0051100 | A1 | 3/2007 | Kauss | |
| 2007/0056277 | A1 | 3/2007 | Mizoguchi et al. | |
| 2007/0056280 | A1 | 3/2007 | Bitter | |
| 2007/0227133 | A1 | 10/2007 | Aarestad et al. | |
| 2009/0000290 | A1 | 1/2009 | Brinkman | |
| 2009/0158726 | A1 * | 6/2009 | Hanks | E02F 9/2207 60/416 |
| 2010/0162885 | A1 * | 7/2010 | Hughes, IV | E02F 3/844 91/361 |

FOREIGN PATENT DOCUMENTS

| | | |
|---|---|---|
| CN | 101220823 A | 7/2008 |
| EP | 0 436 740 | 7/1991 |
| EP | 1 790 781 | 5/2007 |
| EP | 1 793 128 | 6/2007 |
| JP | H10 168949 | 6/1998 |
| JP | 2008 121893 A | 5/2008 |
| JP | 2008 267595 | 11/2008 |

OTHER PUBLICATIONS

Written Opinion of the International Searching Authority for corresponding patent application No. PCT/US2013/020513 dated Jul. 9, 2013.
International Preliminary Report on Patentability for corresponding patent application No. PCT/US2013/020513 dated May 15, 2014.

* cited by examiner

ELECTRO-HYDRAULIC SYSTEM WITH FLOAT FUNCTION

RELATED APPLICATIONS

This application is a national phase of International Application No. PCT/US2013/020513 filed on Jan. 7, 2013 and published in the English language, which claims the benefit of U.S. Provisional Application No. 61/583,356 filed Jan. 5, 2012, which is hereby incorporated herein by reference.

FIELD OF INVENTION

The present invention relates generally to hydraulic systems, and more particularly to an electro-hydraulic system utilizing a directional control valve and a discharge valve configured to provide a float function for a hydraulic cylinder.

BACKGROUND

In the case of performing work using an excavator or similar vehicle, the primary purpose of a float valve is to return hydraulic fluid to a hydraulic tank by making flow paths of the bore chamber side and rod chamber side of boom cylinders communicate with each other during a boom-down operation. In the prior art, the float function is usually achieved by a directional control valve with a special spool which has a "4th position" in which the pump supply is blocked and both cylinder ports are connected to the reservoir.

SUMMARY OF INVENTION

Described herein is a solution for achieving a float function for a hydraulic actuator taking advantage of advantages associated with electric displacement controlled pumps (use of such pumps in hydraulic systems gives advantages inn response, stability, efficiency, and productivity). Thus, both sides of a hydraulic cylinder may be connected to tank (cylinder function is "floating"), while the limited amount of flow delivered by the pump is discharged to tank through a separate discharge valve. Therefore, use of a four-position valve, which is more complicated than is necessary, may be avoided. The introduction of an electronically-controlled variable-capacity pump allows for a simpler valve assembly and more efficient pump operation during a float function.

According to one aspect of the invention, a method of controlling a float function of a cylinder having a first side and a second side includes connecting a second side of the cylinder to a reservoir; connecting the first side of the cylinder to an output of a pump and to the reservoir; and supplying an amount of flow from a pump less than an amount supplied by the pump under loaded conditions.

Optionally, connecting the first side of the cylinder to the reservoir includes opening a discharge valve between the first side of the cylinder and the reservoir.

Optionally, connecting the second side of the cylinder to the reservoir and connecting the first side of the cylinder to the output of the pump includes actuating a directional control valve connected to the first side of the cylinder, to the second side of the cylinder, to the reservoir, and to the output of the pump.

Optionally, supplying an amount of flow from the pump less than an amount supplied by the pump under loaded conditions includes reducing the capacity of a variable capacity pump.

Optionally, the variable capacity pump is an electric displacement control pump.

According to another aspect of the invention, a hydraulic valve assembly includes a directional control valve having a pump port, a reservoir port, a first cylinder port, and a second cylinder port; and a discharge valve having a first position defining a closed fluid path and a second position defining an open fluid path between a first cylinder port of the discharge valve and a reservoir port of the discharge valve. The directional control valve has a first position defining an open fluid path between the pump port and the second cylinder port, and an open fluid path between the first cylinder port and the reservoir port. The directional control valve has a second position defining an open fluid path between the pump port and the first cylinder port and an open fluid path between the second cylinder port and the reservoir port.

Optionally, the hydraulic valve assembly includes a ride control valve with a first position defining a closed fluid path and a second position defining an open fluid path from a cylinder port of the ride control valve to an accumulator port of the ride control valve.

Optionally, the hydraulic valve assembly includes an electric displacement control pump fluidly coupled to the pump port.

Optionally, the hydraulic valve assembly includes an electronic control unit configured to control the directional control valve to move into the second position and to control the discharge valve to move into the second position to enable a float function of the hydraulic valve assembly.

Optionally, the electronic control unit, when enabling the float function of the hydraulic valve assembly, is configured to control a variable capacity pump to supply an amount of flow less than an amount supplied by the pump under loaded conditions.

Optionally, the directional control valve is a three-position valve.

According to another aspect of the invention, a system includes a reservoir; a pressure cylinder; a variable capacity pump; a directional control valve having: a first position connecting the pump to a first side of the pressure cylinder and connecting a second side of the pressure cylinder to the reservoir, a second position connecting the pump to a second side of the pressure cylinder and connecting a first side of the pressure cylinder to the reservoir, and a third position blocking fluid flow to and from the pressure cylinder; a discharge valve that when opened, when the directional control valve is in the second position, connects the pump and the second side of the pressure cylinder to the reservoir; and an electronic control unit configured to control the position of the directional control valve, the activation of the discharge valve, and the displacement of the pump.

Optionally, the system includes an accumulator connected to the first side of the pressure cylinder and a ride control valve positioned between the accumulator and the first side of the pressure cylinder, wherein the electronic control unit is configured to open the ride control valve when the directional control valve is in the third position.

Optionally, the directional control valve is limited to three operating positions.

Optionally, the variable capacity pump includes electric displacement control.

Optionally, the position of the directional control valve, the activation of the discharge valve, and the displacement of the pump are controlled by a plurality of solenoids that are electrically activated by the electronic control unit.

The foregoing and other features of the invention are hereinafter described in greater detail with reference to the accompanying drawings.

DETAILED DESCRIPTION

Figure 1:
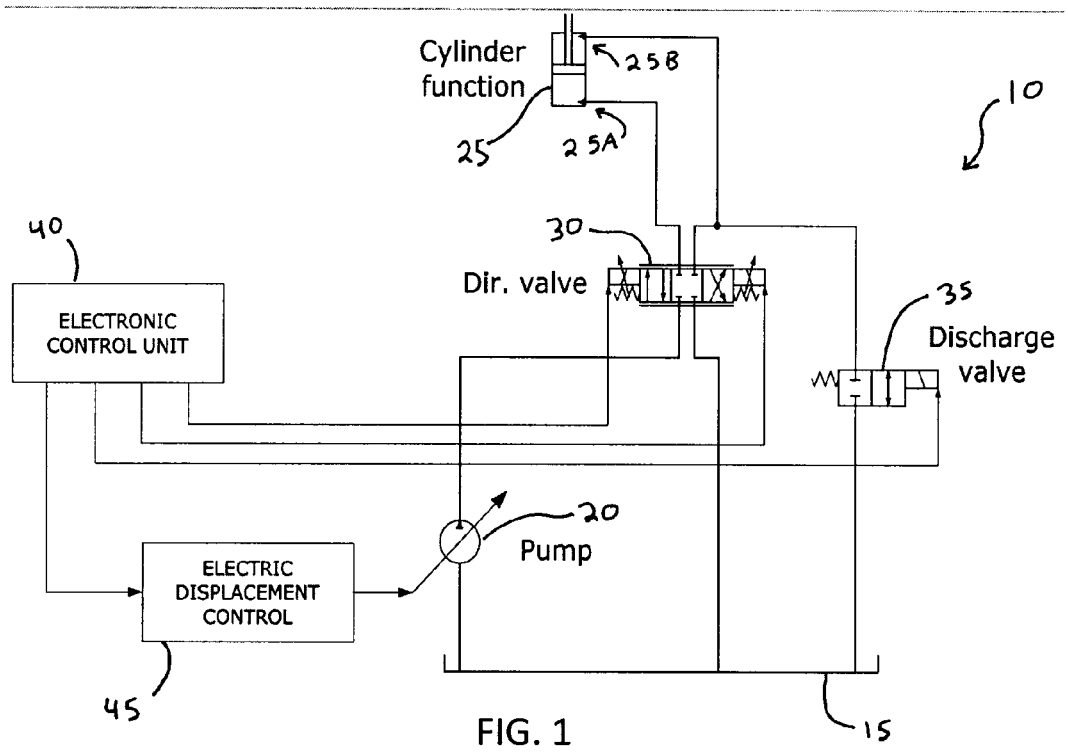
FIG. 1 is an exemplary schematic view of a hydraulic system layout which enables a float function.

Referring to FIG. 1, an exemplary hydraulic valve system 10 is shown in schematic. The system 10 includes a reservoir 15, a pump 20, a hydraulic cylinder 25, a directional valve 30, a discharge valve 35, an electronic control unit (ECU) 40, and electric placement control 45.

The pump 20 may be a variable-capacity hydraulic pump in which the displacement is electrically controlled (e.g., using solenoids) by the electric displacement control 45.

The directional control valve 30 may be, for example, proportional and solenoid operated (the position of the valve spool is proportional to an input current or voltage). The directional control valve 30 may be connected to the outlet of the pump 20, the reservoir 15, and first and second ports (bore-side and rod-side) of the hydraulic cylinder 25. The directional control valve 30 may have a pump port for connecting to the pump 20, a reservoir port for connecting to the reservoir 15, a first (for example, a rod-side) cylinder port for connecting to the first (for example, rod) side 25B of the cylinder 25, and a second (for example, bore-side) cylinder port for connecting to a second (for example, bore) side 25A of the cylinder 25. (The sides of the cylinder may be switched depending on the specific configuration of the exemplary system.) The exemplary directional control valve 30 is a three position valve.

The directional control valve 30 may have a first position defining an open fluid path between the pump port and the bore-side cylinder port, and an open fluid path between the rod-side cylinder port and the reservoir port.

The directional control valve 30 may also have a second position defining an open fluid path between the pump port and the rod-side cylinder port and an open fluid path between the bore-side cylinder port and the reservoir port.

Further, the directional control valve may also have a third position (for example, the neutral position) that defines a closed fluid path, preventing fluid from flowing to or from any of the ports of the directional control valve.

The discharge valve 35 may be solenoid controlled and is shown as a two position valve (open/close) arranged between the rod side of the hydraulic cylinder 25 and the reservoir 15. The first position defines a closed fluid path and the second position defines an open fluid path between a rod-side cylinder port of the discharge valve and a reservoir port of the discharge valve.

The ECU 40 may receive input signals from, for example, user controls, such as one or more joysticks. Alternatively or additionally, the ECU 40 may include autonomous programming which generates command signals without user input. The ECU 40 may, based on the input and/or generated command signals, provide output signals to control solenoids of the discharge valve 35, directional control valve 30, electric displacement control 45, and any other connected devices.

Figure 2:
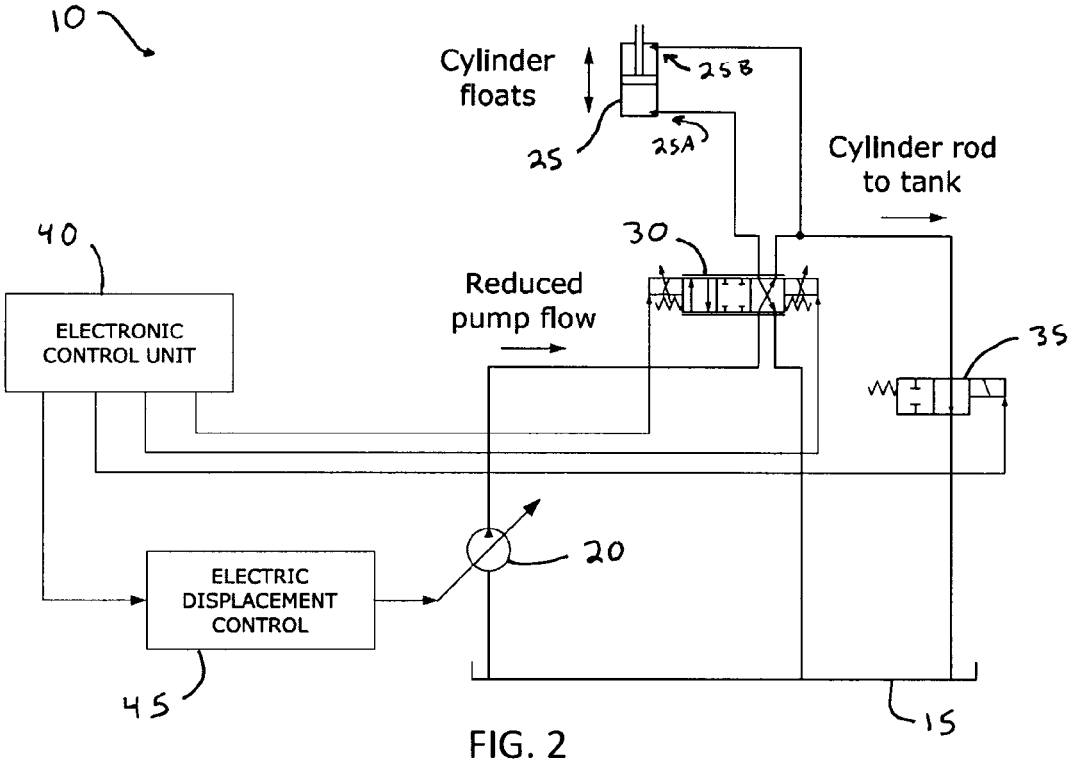
FIG. 2 is an exemplary schematic view of the operation of the hydraulic system of FIG. 1 showing the system in a float function configuration.

FIG. 2 shows the system 10 with the valves configured to enable the "float function" of the system. The electronic control unit is configured to control the directional control valve 30 to move into its second position and to control the discharge valve 35 to move into its second position. Specifically, the directional valve 30 is commanded by the ECU 40 to connect the bore side 25A of the cylinder to the reservoir 15 and the rod side 25B to the outlet of the pump 20. The ECU 40 commands the discharge valve 35 to connect the rod side 25B to the reservoir 15. The ECU 40 also commands the pump 20 to deliver a reduced amount of flow, compared to a "power down" or other operation. Thus, both sides of the hydraulic cylinder are connected to tank (cylinder function is "floating"), while the limited amount of flow delivered by the pump is discharged to tank through the discharge valve.

Figure 3:
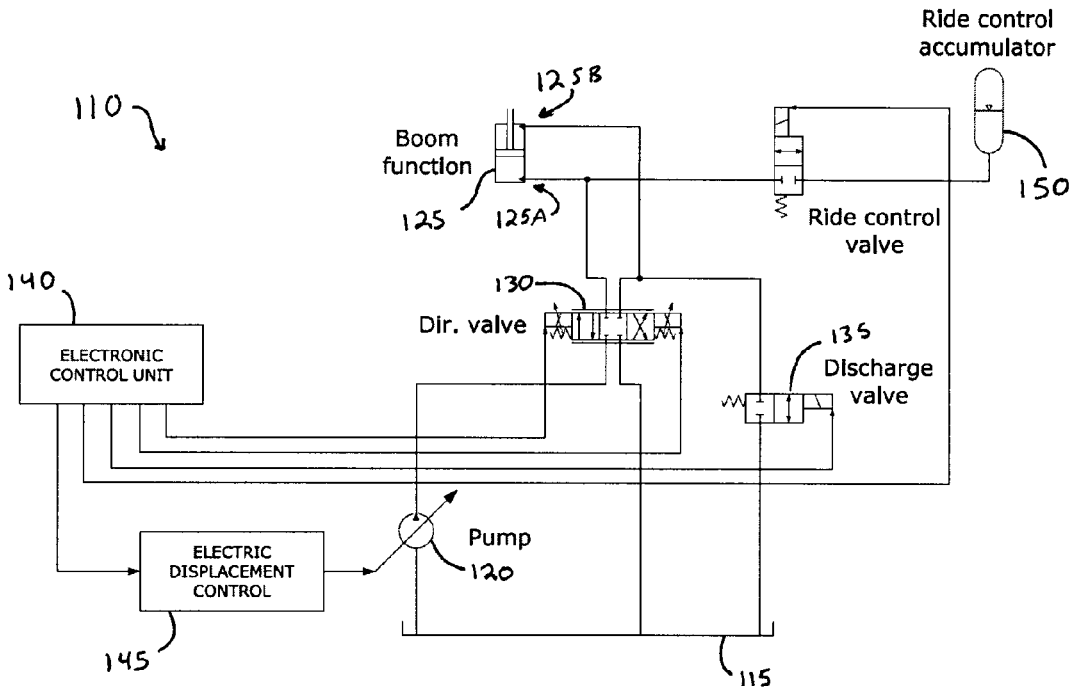
FIG. 3 is another exemplary schematic view of a hydraulic system which enables a float function and includes ride control.

Referring now to FIG. 3, another exemplary hydraulic system 100 is illustrated in schematic. The system 100 is substantially the same as the above-referenced hydraulic system 10, and consequently the same reference numerals but indexed by 100 are used to denote structures corresponding to similar structures in the hydraulic system. In addition, the foregoing description of the hydraulic system 10 is equally applicable to the hydraulic system 100 except as noted below. Moreover, it will be appreciated upon reading and understanding the specification that aspects of the hydraulic systems may be substituted for one another or used in conjunction with one another where applicable.

System 100 includes an additional feature beyond the float function (as explained above): a ride control function. The system 100 further includes a hydraulic accumulator 150 connected to the bore side 125A of the cylinder 125, a ride control valve 155 positioned between the bore side 125A of the cylinder and the accumulator 150. The ride control valve 155 has a first position defining a closed fluid path and a second position defining an open fluid path from a bore-side cylinder port of the ride control valve 155 to an accumulator port of the ride control valve 155. The discharge valve 135, as described above, is positioned between the rod side 125B of the cylinder 125 and the reservoir 115. The ride control function is engaged by leaving the directional valve 130 in the neutral (closed) position and opening the ride control valve 155 and the discharge valve 135.

Figure 4:
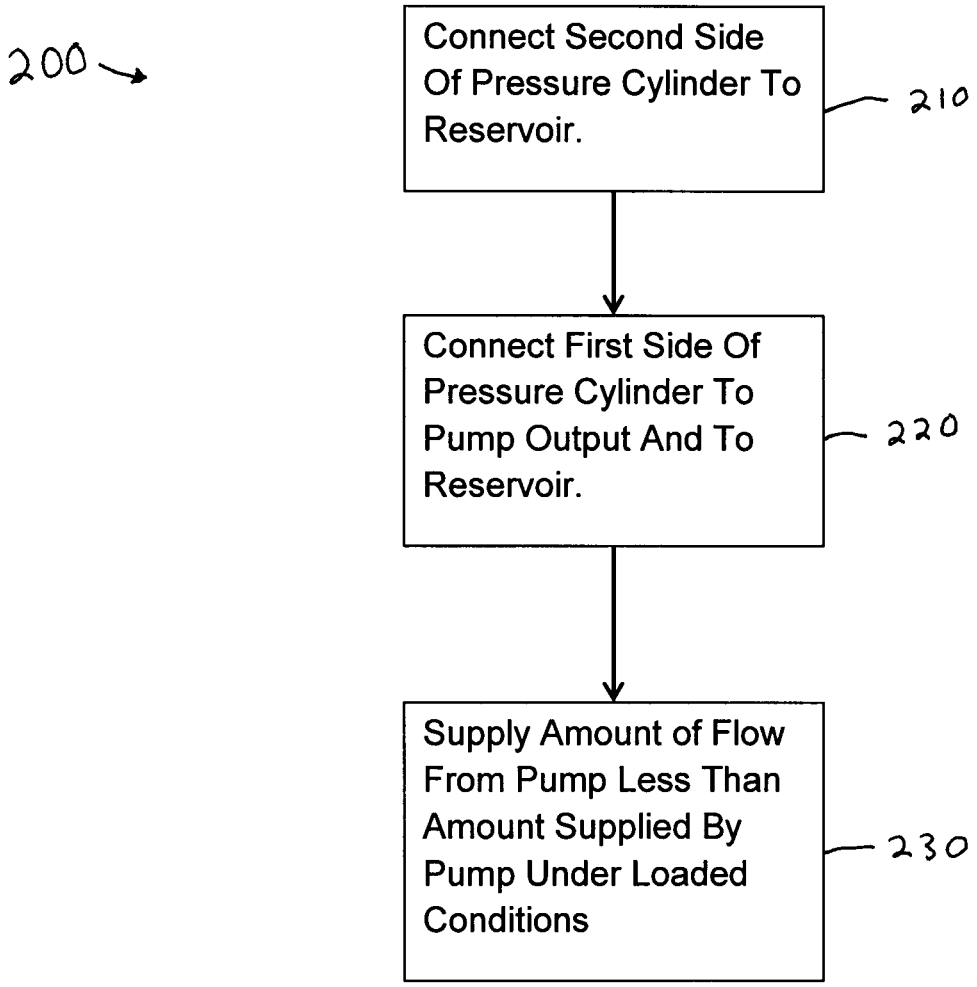
FIG. 4 is an exemplary method of controlling a fluid system which enables a float function.

FIG. 4 depicts a flow chart illustrating a method 200 of controlling a float function of pressure cylinder having a rod side and a bore side. The method 200 may be executed by, for example, the electronic control unit 40, 140 discussed above.

At block 210, the bore side 25A, 125A of the cylinder is connected to a reservoir 15, 115. Block 210 may specifically include actuating a directional control valve connected between the bore side of the cylinder and the reservoir.

At block 220, the rod side of the cylinder is connected to an output of a pump and to the reservoir. Block 220 may specifically include opening a discharge valve between the rod side of the cylinder and the reservoir, and opening a directional control valve between the rod side of the cylinder and the pump.

At block 230, an amount of flow from a pump less than an amount supplied by the pump under loaded conditions is supplied. Block 230 may specifically include reducing the capacity of a variable capacity pump. The variable capacity pump may be an electric displacement control pump.

Although the illustrated method illustrates a specific order of executing functional logic blocks, the order of execution of the blocks may be changed relative to the order shown and/or may be implemented in a state-driven or an object-oriented manner. Also, two or more blocks shown in succession may be executed concurrently or with partial concurrence. Certain blocks also may be omitted. Further, although certain blocks have been described as being executed or performed by specific functional components of the system, these blocks need not be performed by these components or may be performed by one or more other components. It is understood that all such variations are within the scope of the present invention.

Any of the blocks of the method 200 may be embodied as a set of executable instructions (e.g., referred to in the art as code, programs, or software) that are respectively resident in and executed by the ECU 40, 140 and/or the Electric Displacement Control 45, 145. The method 200 may be one or more programs that are stored on respective non-transitory computer readable mediums, such as one or more memory devices (e.g., an electronic memory, a magnetic memory, or an optical memory).

The exemplary embodiments described herein enable the float function (as illustrated in FIG. 2) without adding any specialized components (such as a four position directional control valve) to the system, since the discharge valve may already be present in the system (for example, in systems having a ride control function). Thus, the directional control valve can remain a traditional 4 way 3 position valve, and no 4th position float is needed. Usually this 4th position causes additional costs and complications in the system.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of controlling a float function of a cylinder having a first side and a second side, the method comprising:

connecting the second side of the cylinder to a reservoir, and fluidly isolating a pump from the second side of the cylinder;

connecting the first side of the cylinder to an output of the pump and to the reservoir, wherein the first side in connected to the reservoir through a discharge valve; and supplying an amount of flow from a pump that is less than an amount supplied by the pump under loaded conditions, thereby enabling a float function of the cylinder while the limited amount of flow delivered by the pump is discharged to the reservoir, wherein when the float function occurs the first side and the second side of the cylinder both have a cylinder pressure that is equal to a reservoir pressure of the reservoir, and the first side and the second side of the cylinder are both fluidly connected to the reservoir such that at the reservoir pressure each side of the cylinder can receive fluid from and expel fluid to the reservoir while the second side is fluidly isolated from the pump, wherein when the float function occurs the second side of the cylinder is only fluidly connected to a directional control calve in relation to the discharge valve so that the second side is isolated from the discharge valve.

2. The method of claim 1, wherein connecting the first side of the cylinder to the reservoir comprises opening a discharge valve between the first side of the cylinder and the reservoir.

3. The method of claim 1, wherein connecting the second side of the cylinder to the reservoir and connecting the first side of the cylinder to the output of the pump comprises actuating a directional control valve connected to the first side of the cylinder, to the second side of the cylinder, to the reservoir, and to the output of the pump.

4. The method of claim 1, wherein supplying an amount of flow from the pump less than an amount supplied by the pump under loaded conditions comprises reducing the capacity of a variable capacity pump.

5. The method of claim 1, wherein the pump is an electric displacement control pump.

6. A hydraulic valve assembly comprising:

a directional control valve having a pump port, a reservoir port, a first cylinder port, and a second cylinder port, wherein the directional control valve is a three-position valve; and a discharge valve having a first position defining a closed fluid path and a second position defining an open fluid path between a first cylinder port of the discharge valve and a reservoir port of the discharge valve, wherein the directional control valve has a first position defining an open fluid path between the pump port and the second cylinder port, and an open fluid path between the first cylinder port of the directional control valve and the reservoir port of the directional control valve, wherein the directional control valve has a second position defining an open fluid path between the pump port and the first cylinder port of the directional control valve and an open fluid path between the second cylinder port and the reservoir port of the directional control valve, and wherein the assembly further comprises an electronic control unit configured to control the directional control valve to move into the second position and to control the discharge valve to move into the second position to enable a float function of the hydraulic valve assembly, wherein when the float function occurs the first cylinder port and the second cylinder port of the directional control valve both have a cylinder pressure that is equal to a reservoir pressure of the reservoir port of the directional control valve, and the first cylinder port and the second cylinder port of the directional control valve are fluidly connected to one of the reservoir ports such that at the reservoir pressure each cylinder port of the directional control valve can receive fluid from and expel fluid to the corresponding reservoir port, wherein when the float function occurs the second cylinder port of the directional control valve is only fluidly connected to the directional control valve in relation to the discharge valve so that the second cylinder port of the directional control valve is isolated from the discharge valve.

7. The hydraulic valve assembly of claim 6, further comprising a ride control valve with a first position defining a closed fluid path and a second position defining an open fluid path from a cylinder port of the ride control valve to an accumulator port of the ride control valve.

8. The hydraulic valve assembly of claim 6, further comprising an electric displacement control pump fluidly coupled to the pump port.

9. The hydraulic valve assembly of claim 6, wherein the electronic control unit, when enabling the float function of the hydraulic valve assembly, is configured to control a variable capacity pump to supply an amount of flow less than an amount supplied by the pump under loaded conditions.

10. A system comprising:

a reservoir;

a pressure cylinder;

a variable capacity pump;

a directional control valve that is limited to three operating positions, the directional control valve having:

a first position connecting the pump to a first side of the pressure cylinder and connecting a second side of the pressure cylinder to the reservoir, a second position connecting the pump to the second side of the pressure cylinder and connecting the first side of the pressure cylinder to the reservoir, and a third position blocking fluid flow to and from the pressure cylinder;

a discharge valve that when opened, when the directional control valve is in the second position, connects the pump and the second side of the pressure cylinder to the reservoir; and an electronic control unit configured to control the position of the directional control valve, the activation of the discharge valve, and the displacement of the pump, wherein the electronic control unit is configured to control the directional control valve to move into the second position and to control the discharge valve to move into the second position to enable a float function of the hydraulic valve assembly, wherein when the float function occurs the first side and the second side of the pressure cylinder both have a cylinder pressure that is equal to a reservoir pressure of the reservoir, and the first side and the second side of the pressure cylinder are both fluidly connected to the reservoir such that at the reservoir pressure each side of the pressure cylinder can receive fluid from and expel fluid to the reservoir, wherein when the float function occurs the first side of the pressure cylinder is only fluidly connected to the directional control valve in relation to the discharge valve so that the first side is isolated from the discharge valve.

11. The system of claim 10 further comprising an accumulator connected to the first side of the pressure cylinder and a ride control valve positioned between the accumulator and the first side of the pressure cylinder, wherein the electronic control unit is configured to open the ride control valve when the directional control valve is in the third position.

12. The system of claim 10, wherein the variable capacity pump includes electric displacement control.

13. The system of claim 10, wherein the position of the directional control valve, the activation of the discharge valve, and the displacement of the pump are controlled by a plurality of solenoids that are electrically activated by the electronic control unit.

14. The hydraulic valve assembly of claim 6, wherein the discharge valve is arranged between the first cylinder port of the directional control valve and a reservoir.

15. The hydraulic valve assembly of claim 6, wherein the discharge valve is arranged between a first side of a hydraulic cylinder and a reservoir.

16. The system of claim 10, wherein the discharge valve is arranged between a first cylinder port of the directional control valve and the reservoir.

17. The system of claim 10, wherein the discharge valve is arranged between a first side of the hydraulic cylinder and the reservoir.

18. The method of claim 1, wherein when the float function occurs a discharge valve fluidly connects the first side of the cylinder to the reservoir while the second side of the cylinder is fluidly isolated from the pump.

* * * * *